United States Patent [19]

Öser

[11] 4,002,433

[45] Jan. 11, 1977

[54] HEAT SHIELD FOR A CATALYTIC EMISSION CONTROL DEVICE

[75] Inventor: Polat Öser, Wolfsburg, Germany

[73] Assignee: Volkswagenwerk Aktiengesellschaft, Wolfsburg, Germany

[22] Filed: Oct. 28, 1975

[21] Appl. No.: 626,293

Related U.S. Application Data

[63] Continuation of Ser. No. 452,704, March 19, 1974, abandoned.

[30] Foreign Application Priority Data

Mar. 23, 1973 Germany ..... 2314465

[52] U.S. Cl. ..... 23/288 FC; 60/299; 60/301

[51] Int. Cl.[2] ..... B01J 8/02; B01J 35/04; F01N 3/15

[58] Field of Search ..... 23/288 FC; 181/72; 138/39, 41, 42; 55/DIG. 30; 60/299, 301

[56] References Cited

UNITED STATES PATENTS

| | | | |
|---|---|---|---|
| 2,077,563 | 4/1937 | Henry | 23/288 F |
| 3,211,534 | 10/1965 | Ridgway | 23/288 FC |
| 3,771,967 | 11/1973 | Nowak | 23/288 FC |
| 3,798,006 | 3/1974 | Balluff | 23/288 FC |

*Primary Examiner*—Morris O. Wolk
*Assistant Examiner*—Michael S. Marcus
*Attorney, Agent, or Firm*—Brumbaugh, Graves, Donohue & Raymond

[57] ABSTRACT

A device for catalytic purification of exhaust gas from an internal combustion engine includes a housing and a catalyst carrier mounted within the housing. The device communicates with the exhaust line from the engine so that exhaust gas flows through the catalyst carrier, entering and exiting from the carrier through different ends of the carrier. Disposed within the housing of the device adjacent at least one end of the carrier is a heat shield. The shield protects a wall of the housing against the heat from the exhaust gas flowing through the housing. The heat shield is particularly suitable for a catalytic purification device in which the catalyst carrier is mounted in the housing by an elastic support compressed between the carrier and the housing.

4 Claims, 4 Drawing Figures

HEAT SHIELD FOR A CATALYTIC EMISSION CONTROL DEVICE

This is a continuation of application Ser. No. 452,704, filed Mar. 19, 1974, now abandoned.

BACKGROUND OF THE INVENTION

To meet the increasingly stringent regulations regarding the content of exhaust gases from internal combustion engines, which are being proposed and enforced in the United States and other countries, devices have been developed to purify the exhaust gases. One type of purification device is connected to the exhaust system of a vehicle, such as an automobile, so as to treat gases exhausted from the vehicle engine cylinders before the gases are released to the atmosphere. Typically, the device includes an appropriate catalyst, generally in the form of an active coating on a carrier material or member, for converting noxious exhaust gas components, such as carbon monoxide, uncombusted hydrocarbons, and nitric oxides, into harmless components.

One such device for catalytic exhaust gas purification or emission control is described and illustrated in German Auslegeschrift (DAS) No. 1,476,507 and in corresponding U.S. Pat. No. 3,441,381. The catalytic device of the German publication includes a housing and a monolithic carrier member for a catalyst. The catalyst carrier is supported in the housing by a layer of elastic material disposed between the carrier and the wall of the housing. The particular elastic support described and illustrated in the German publication is a corrugated member fabricated of wire mesh and encircling the carrier. In another catalytic device, as described in commonly owned, copending U.S. patent application Ser. No. 403,270, filed Oct. 3, 1973, the elastic support is a prestressed fibrous ceramic material, such as aluminum silicate. As noted in that application, a suitable material of this type is sold under the trademark "Fiberfrax".

In catalytic converters of the type described and illustrated in the German publication and the U.S. Patent application, a compressive stress on the elastic support must be maintained at or above a predetermined minimum value throughout the entire range of operating temperatures of the associated internal combustion engine in order to insure that the catalyst carrier will always be securely supported in the housing. In the lower performance range of an internal combustion engine, during which the temperature of the exhaust gas from the engine is comparatively low, the requirement of a minimum compressive stress is easily met. In the upper range of engine performance, however, the exhaust gas may reach a temperature high enough to have an adverse effect on the functioning of the elastic support. Specifically, except for the portion of the housing where the elastic support mounts the monolithic carrier, the exhaust gas flowing through the converter directly contacts the full surface area of the walls of the housing. Consequently, the housing walls fully exposed to the gas may be quickly heated to very high temperatures. The high temperatures of the exposed walls are then transmitted throughout the housing, because of the heat conductivity of the housing material, so that even in the portion of the housing where the carrier is mounted, the temperature of the housing is remarkably above the ambient atmospheric temperature. The heated housing expands away from the catalyst carrier and the compressive stress on the elastic support is correspondingly reduced. As the compressive stress is reduced, the elastic support holds the carrier less firmly in the housing. When subjected to resonant vibrations produced by the vehicle engine, the carrier can shake loose from the housing and be damaged or otherwise adversely affect the operation of the converter.

Since the catalyst carrier is generally located in the central longitudinal portion of a converter housing, the end portions of the housing, which are directly and fully contacted by the exhaust gas, tend to attain higher temperatures than the central portion. In addition to the overall expansion of the housing, therefore, the ends of the housing expand to a greater extent because of their higher temperatures. The differential expansion tends to reduce the length of housing wall applying compressive stress on the elastic support member. Thus, such differential expansion of the housing also facilitates the carrier shaking loose and the resultant adverse effects on the operation of the converter.

SUMMARY OF THE INVENTION

The present invention is directed to apparatus for shielding a wall of a housing of a device for catalytic purification of exhaust gas against the heat from exhaust gas flowing through the device. Such a catalytic purification or emission control device communicates with an exhaust line for the engine so that exhaust gas flows through the catalyst carrier for the device, entering and exiting from the carrier through different ends of the carrier. The heat shield apparatus of the invention is disposed within the housing and is located adjacent at least one end of the catalyst carrier. The apparatus is particularly suited for use in a purification device that has an elastic support located between the catalyst carrier and the housing for the device and normally stressed in compression between the carrier and the housing.

The heat shield apparatus of the present invention protects the otherwise exposed walls at the ends of the housing for a catalytic converter against excessive heating and prevents significant expansion of the housing end walls during operation of an associated internal combustion engine. Since the walls at the ends of the housing are not excessively heated, excessive temperatures are not conducted to the central portion of the housing in which the catalyst carrier is mounted Moreover, since the catalyst carrier is generally fabricated of material with poor heat conducting properties and, at least for fibrous ceramic supports, the elastic support for the carrier also has poor heat conducting properties, the converter housing is also insulated from the conversion reaction carried out within the catalyst carrier. The end result is that the compressive stress applied to the elastic support is not appreciably reduced and the catalyst carrier remains securely mounted within the housing.

In one embodiment of the invention, the heat shield apparatus includes a tubular shield member located adjacent one end of the catalyst carrier and at least a portion of the shield member is oriented parallel to and spaced from the housing wall. The end of the shield member farther from the carrier is coupled to the housing, for example by welding. The shield member thus physically separates the exhaust gases from the housing wall and, in addition, provides a space between itself and the housing wall which is filled with essentially stationary exhaust gas to provide an additional heat insulating layer.

The downstream end of a tubular shield member upstream of the catalyst carrier, when viewed in longitudinal section, may be advantageously extended radially inwardly of the shield member. In section, therefore, the end of the shield member resembles a hook and tends to divert exhaust gas flow radially inwardly of the housing toward the passages in the catalyst carrier and away from the elastic support surrounding the carrier. The length of the hook can be such, in fact, that most of the exhaust gas flow through the converter is diverted away from the radially outermost portion of the catalyst carrier, which then fills with generally stationary exhaust gas and acts as an additional heat insulating layer. The end of the shield member may also be extended radially outwardly of the member and utilized, for example, to restrain the catalyst carrier and/or the elastic support against longitudinal movement.

The shield member may also be provided with an element, such as disclosed in commonly owned, copending U.S. Patent application Ser. No. 440,781, filed Feb. 8, 1974 for distributing the flow of exhaust gas to the catalyst carrier. The distributing element tends to produce a uniform flow profile for the exhaust gases passing through the catalyst carrier.

In another embodiment of the invention, the heat shield apparatus includes a heat insulating lining contiguous with the inner surface of a portion of the housing wall. Fibrous ceramic material, such as used for the elastic support, may be used to provide the heat insulating lining.

BRIEF DESCRIPTION OF THE DRAWINGS

For a better understanding of the invention, reference may be made to the following description of four exemplary embodiments, taken in conjunction with the figures of the accompanying drawings, in which.

DESCRIPTION OF EMBODIMENTS

Figure 1:
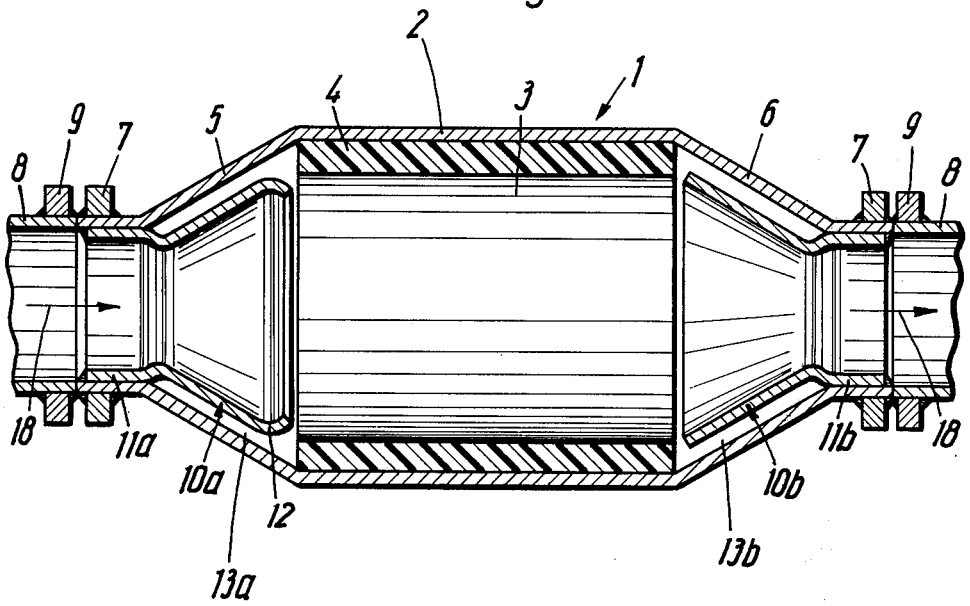
FIG. 1 is a side sectional view of a device for catalytic purification of exhaust gas from an internal combustion engine and having a heat shield according to the invention.

FIG. 1 of the drawings illustrates a catalytic converter, generally designated 1, for controlling emissions from an internal combustion engine (not shown). The converter 1 has a housing with a cylindrical central portion 2 and two conical end portions 5 and 6. The housing portions 2, 5 and 6 are fabricated of sheet metal and may together be formed of a single sheet or may be separate members that are welded or otherwise secured together. The housing may also be fabricated of pressed insulation material.

The central portion 2 of the converter 1 accommodates a monolithic catalyst carrier 3 formed of a porous ceramic material. The carrier 3 is mounted in the central housing portion 2 by an elastic annular support 4. The support 4, as shown, is fabricated of a fibrous ceramic material, but may be fabricated of any other elastic material that can be subjected to a compressive stress between the carrier 3 and the central portion 2 of the housing. The carrier 3 may alternatively be comprised, for example, of a number of corrugated plates stacked so as to provide hollow free spaces between them. It is also possible to have a carrier, mounted in the manner illustrated in FIG. 1, which comprises an outer portion of essentially rigidly connected particles with an inner mass of discrete, closely packed particles, such as disclosed in commonly owned, copending United States application Ser. No. 316,839, filed Dec. 20, 1972.

The housing end portions 5 and 6 of the converter 1 are coupled to an exhaust line 8 extending from the exhaust of the internal combustion engine (not shown). Each housing end portion 5 and 6 is provided with a flange 7 extending radially outwardly from the housing portion and corresponding to a similar flange 9 formed on the adjacent end of the exhaust line 8. A coupling (not shown), such as a lag bolt or a bolt and nut combination, engages adjacent flanges 7 and 9 to secure the converter 1 to the exhaust line 8.

Both upstream and downstream from the catalyst carrier 3, according to the direction of exhaust gas flow indicated by the arrows 18 in FIG. 1, tubular heat shields **10*a* and 10*b* fabricated of sheet metal or a pressed insulation material are coupled to the housing end portions 5 and 6. Each of the shields 10*a* and 10*b* has a generally cylindrical end 11*a* and 11*b* that closely fits into the narrow neck of one of the housing end portions 5 and 6. The other end of each shield 10*a* and 10*b* has a generally conical shape, corresponding to the conical shape of the housing end portions 5 and 6. The cylindrical ends 11*a* and 11*b* of the heat shields 10*a* and 10*b* may be press fit or welded to the necks of the housing end portions 5 and 6. The conical ends of the heat shields 10*a* and 10*b* lie generally parallel to the conical housing end portions 5 and 6 but are spaced from the end portions 5 and 6 to provide annular chambers 13*a* and 13*b*. The heat shields 10*a* and 10*b* may be of any other configuration depending upon the configuration of the converter housing 1**.

The tubular heat shields **10*a* and 10*b* prevent heated exhaust gas flowing into the converter 1 from coming directly into contact with the walls of the end portions 5 and 6 of the converter 1. The walls of the converter are also shielded against heat radiated from the exhaust gas. As a result, the housing of the converter 1 heats up at a comparatively slow rate and the maximum temperature that the housing achieves does not exceed a maximum permissible value. The permissible range of temperatures for the housing is determined by the minimum compressive stress to be maintained on the elastic support 4 mounting the catalyst carrier 3 in the converter 1. The effectiveness of the shields 10*a* and 10*b* is also enhanced by the insulating effect of essentially stationary exhaust gas trapped in the annular chambers 13*a* and 13*b*** between the shields and the housing walls.

As shown in FIG. 1, the end 12 of the upstream shield **10*a* closest to the catalyst carrier 3 extends radially inwardly of the shield. The hooked shape of the shield end 12 diverts the flow of exhaust gas so that gas leaving the shield 10*a* does not flow radially outwardly toward the converter housing or the elastic support 4, but rather is directed radially inwardly toward the catalyst carrier 3. The length of the hook-like end 12** may be such that exhaust gas is only directed to the central portion of the catalyst carrier 3 and the peripheral, radially outer portion of the carrier is not charged with flowing gas, but with essentially stationary gas. The stationary gas and the peripheral portion of the carrier 3 thus serve as an additional heat insulating layer to shield the central portion 2 of the converter housing against the heat produced by the thermal reaction process occurring within the carrier 3.

Figure 2:
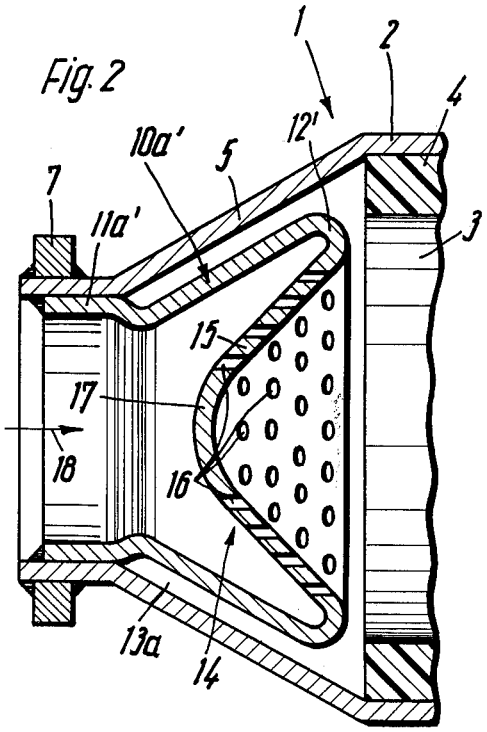
FIG. 2 is a partial sectional view of a catalytic purification device having a second embodiment of a heat shield according to the invention.

FIG. 2 illustrates a second embodiment of the upstream heat shield 10*a'* in which the end 12' of the shield closest to the catalyst carrier 3 is integrally formed with a device, generally designated 14, for distributing the flow of exhaust gas to the carrier. The distributing device 14 includes a metal base portion 15 having a conical shape and a plurality of openings 16 formed in the base portion. The apex portion 17 of the distributing device 14 is generally spherical in shape and no openings are formed in the apex portion. Exhaust gas flowing through the catalytic converter 1, past the heat shield 10*a'*, is distributed by the device 14 in a uniform manner over the adjacent end surface of the carrier 3. The exhaust gas thus flows at a nearly uniform speed and volume rate through each of the flow passages in the catalyst carrier 3. As a result, the entire mass of the catalyst within the carrier 3 is utilized without early depletion of the catalyst in central portion of the carrier 3.

Figure 3:
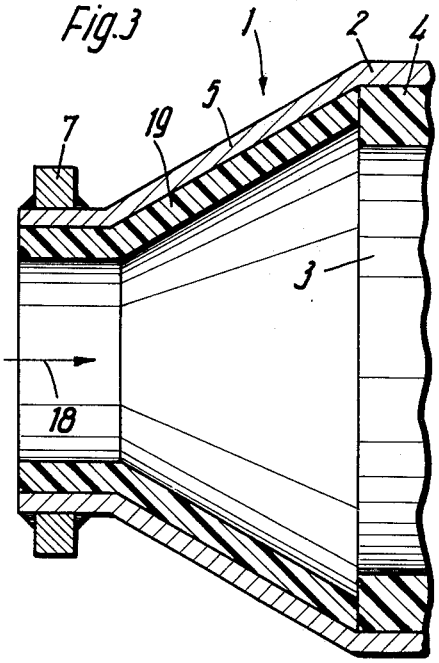
FIG. 3 is a partial sectional view of a catalytic purification device having a third embodiment of a heat shield according to the invention.

Another embodiment of the invention is illustrated in FIG. 3, according to which heat shielding is provided by a heat insulating lining 19. The lining 19 lies against the inner surface of the wall of the housing end portion 5 and may be fabricated of the same fibrous ceramic material used for the elastic support member 4. A similar lining may be utilized in the other end portion (not shown) of the converter housing.

Figure 4:
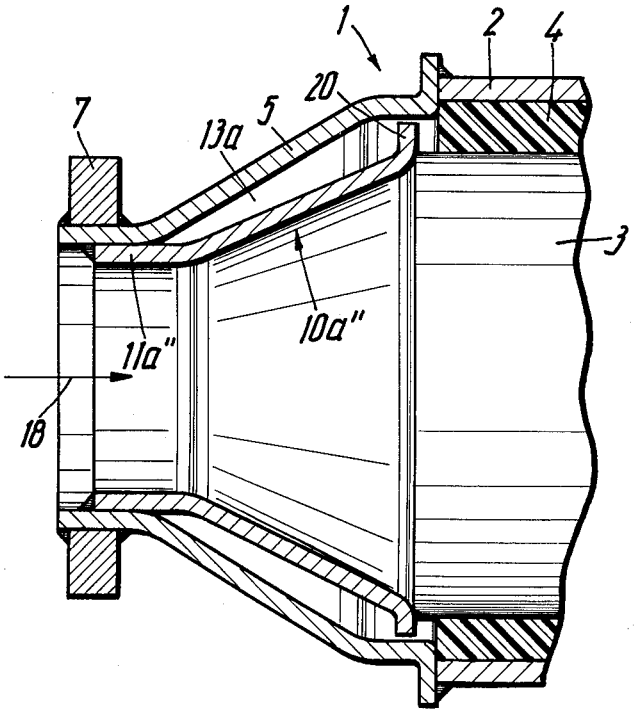
FIG. 4 is a partial sectional view of a catalytic purification device having a fourth embodiment of a heat shield according to the invention.

The heat shield 10*a''* of FIG. 4 is configured with its end adjacent to the catalyst carrier 3 extended radially outwardly of the shield to define a flange 20. The flange 20, together with the elastic support 4, mounts the catalyst carrier 3 in the converter 1 and shields the elastic support 4 from the hot exhaust gas flowing through the converter 1.

It will be understood that the embodiments described above are merely exemplary and that persons skilled in the art may make many variations and modifications without departing from the spirit and scope of the invention. All such modifications and variations are intended to be within the scope of the invention as defined in the appended claims.

I claim:

1. In a device for catalytic purification of exhaust gas from an internal combustion engine including:

a. an annular housing having funnel shaped inlet and outlet means arranged at opposite ends thereof, said annular housing having an internal wall surface;

b. monolithic catalyst carrier means arranged within the housing, and c. annular, elastic support means arranged between the carrier means and the housing, the carrier means being securely mounted in the housing exclusively by the support means which is stressed radially in compression by the housing to mount the carrier means, the inlet and outlet means being adapted to communicate with an exhaust gas line of the engine so that exhaust gas flows through the carrier means entering the exiting through different ends of the carrier means, the improvement comprising heat shield means disposed within, coupled to and supported by the housing for shielding a portion of said internal wall surface of the housing against heat from exhaust gas flowing therethrough, the heat shield means including a funnel shaped shield member located within at least one of said inlet and outlet means adjacent an end of the carrier means with the larger funnel opening facing said end of the carrier means, without applying any supportive force thereto in the axial direction, at least a portion of the shield member being oriented substantially parallel to and spaced from a portion of said internal wall surface of the housing, whereby the heat shield means retards thermal expansion of the housing from reducing the radial compression to the point where the carrier means is no longer securely mounted.

2. The improvement of claim 1, wherein the shield member is coupled to the housing at the end thereof facing away from said carrier means.

3. The improvement of claim 1, wherein at least a portion of the end of said shield member facing toward said carrier means extends substantially radially inwardly in longitudinal section.

4. The improvement of claim 1, wherein the heat shield means further includes means arranged within the shield member for distributing exhaust gas, flowing through the shield member, across the end face of the carrier means.

* * * * *

UNITED STATES PATENT AND TRADEMARK OFFICE

CERTIFICATE OF CORRECTION

PATENT NO. : 4,002,433

DATED : January 11, 1977

INVENTOR(S) : Polat Öser

It is certified that error appears in the above-identified patent and that said Letters Patent are hereby corrected as shown below:

Front page under "References Cited" the following references were omitted:

| | | | |
|---|---|---|---|
| 1,695,554 | 12/18/28 | Markels | 23/288F |
| 3,054,664 | 9/18/62 | Purse | 23/288F |
| 3,189,418 | 6/15/65 | Gary | 23/288FB |
| 3,572,391 | 3/23/71 | Hirsch | 138/41 |
| 3,645,092 | 2/29/72 | Tatsutomi et al | 60/322 |
| 3,692,497 | 9/18/62 | Keith et al | 23/288FC |
| 3,749,130 | 7/31/73 | Howitt et al | 23/288FC |
| 3,780,772 | 12/25/73 | Carnanhan et al | 23/288FB |
| 3,801,289 | 4/2/74 | Wiley | 23/288FC |
| 3,817,714 | 6/18/74 | Wiley | 23/288FC |
| 3,852,042 | 12/3/74 | Wagner | 23/288FC |

Col. 2, line 48, insert "." after --mounted--;
Col. 3, line 18, delete "-" after --and--;
Col. 5, line 26, insert "the" after --in--;
Col. 6, line 18, change "the" to --and--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*